United States Patent [19]

Lowth

[11] 4,159,111

[45] Jun. 26, 1979

[54] LEG EXERCISING APPARATUS

[75] Inventor: Leonard C. Lowth, London, England

[73] Assignee: Scholl, Inc., Chicago, Ill.

[21] Appl. No.: 808,679

[22] Filed: Jun. 21, 1977

[30] Foreign Application Priority Data

Jun. 21, 1976 [GB] United Kingdom ..... 25693/76

[51] Int. Cl.[2] ..... A63B 23/04

[52] U.S. Cl. ..... 272/96; 272/132; 128/25 R

[58] Field of Search ..... 272/96, 126, 93, 132, 272/DIG. 3, DIG. 4, 146, 70; 128/25 B, 25 R; 417/903, 539; 74/89

[56] References Cited

U.S. PATENT DOCUMENTS

| | | | |
|---|---|---|---|
| 494,221 | 3/1893 | Noble | 417/90 |
| 735,319 | 8/1903 | Urwick | 272/146 X |
| 1,974,964 | 9/1934 | Lyons | 417/903 X |
| 2,253,996 | 8/1941 | Bechman | 272/146 |
| 2,374,730 | 5/1945 | Catlin | 272/96 X |
| 2,815,020 | 12/1957 | Barkschat | 128/25 B |
| 3,370,584 | 2/1968 | Girten | 128/25 B |
| 3,525,522 | 8/1970 | Piller | 272/96 |

*Primary Examiner*—Richard J. Johnson

*Attorney, Agent, or Firm*—Hill, Van Santen, Steadman, Chiara & Simpson

[57] ABSTRACT

A leg exerciser for medical purposes, comprising a treadle apparatus including a base with a pair of foot pedals mounted thereon, one for each foot, arranged so that when one is pushed downwardly the other must move upwardly with dorsal and plantar flexion, imitating the muscular actions involved in normal walking. The apparatus is light in weight and can be used by patients to exercise the legs either in a prone or sitting position to reduce pressure in a vein which could lead to varicose veins or worse to thrombosis.

5 Claims, 3 Drawing Figures

LEG EXERCISING APPARATUS

BRIEF SUMMARY OF THE INVENTION

Heretofore, extremely expensive apparatus has been built for massaging a bedridden patient's legs to avoid varicose veins or the development of a thrombus. Due to the expense of such a machine and which is extremely large and could not be carried around by hand from one patient to another, few were used in hospitals, and most of the hospitals relied upon manual manipulation in keep the blood flowing uniformly to a vein back to the heart but muscles in the legs must be exercised for the purposes of aiding in pumping the blood to the heart and keeping low pressure in the veins.

In healthy people, continuous high pressure in the legs can lead to leg fatigue and eventually varicose veins. In medical and surgical patients, and particularly in postoperative patients, the problem can be more serious, because bedridden patients are generally unable to exercise their legs, and this leads to an increased risk of thrombophlebitis or ultimately to a possible coronary thrombosis. The instant invention provides a leg exercising apparatus which enables the patient to exercise his leg muscles from a prone or seated position by dorsal and plantar flexion, thus imitating the muscular actions involved in normal walking. Furthermore, the device is so light in weight that it is easily carried by a nurse and often times may be carried by a mobile patient.

The apparatus includes a plastic base portion to each side of which a foot pedal is pivoted at the heel end, each pedal being made so that the foot will not slip off it.

Centrally thereof the base is provided with an upwardly disposed housing cast integrally with the base and this housing supports a bolt threaded at one end and which functions as an axle for the central portion of a rocker bar having one end connected to the forward part of one pedal and the other end connected to the forward part of the other pedal, the connections being by a dog bone universal joint. A hand wheel having a roughened edge is threaded upon the threaded end of the bolt or axle and tubular nut portion of the hand wheel acts against a series of washers that press against the center of the rocker arm and can thus enable the force required to work the treadle mechanism to be varied in accordance with an individual patient's requirements by virtue of friction placed on the rocker arm.

The device may be made so that many parts of it are plastic which makes it very light in weight.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

BRIEF DESCRIPTION OF THE DRAWING FIGURES

DETAILED DESCRIPTION

Figure 1:
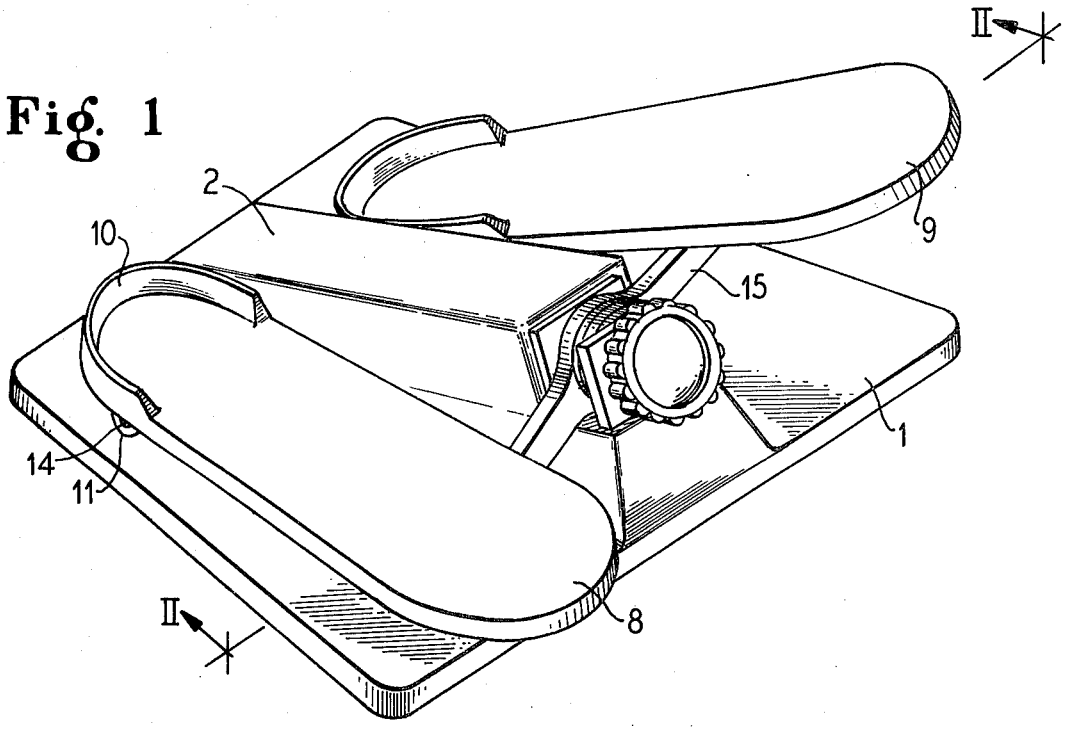
FIG. 1 is a perspective view of a leg exercising apparatus.

The exercise apparatus includes a base 1 preferably formed of a strong and durable molded plastic material such as nylon. Molded integrally with the space is a central upstanding hollow portion 2 open at the bottom. This part 2 slopes upwardly and forwardly from one end of the base 1 to the other.

At its forward end, the part 2 is stepped downwardly to provide an inclined wall 3 connecting the top of the part 2 with a lower wall 4 extending forwardly and joining the front of the elevated portion 2. The wall 3 is apertured to accommodate a bolt-like element threaded at one end as indicated at 5, having a smooth shank 6 which functions as an axle and is provided with a head 7 of greater size than the aperture.

Disposed one on each side of the elevation 2 is a pair of tread plates 8 and 9, plate 8 being for the right foot of the patient and 9 for the left foot. These tread plates are virtually identical in construction and each may be molded from a durable plastic material such as nylon or the equivalent. Each tread plate also has an integral upstanding heel rest 10 to keep the patient's foot from slipping off the plate. Integrally molded with each tread plate and depending from the underside thereof at the heel end of the plate is a pair of lugs 11 and 12 spaced to receive therebetween an upstanding post integrally molded with the base 1. Both depending lugs and the post 13 are apertured to receive a pivot pin 14 therethrough about which the tread plate may swing upwardly and downwardly with respect to the base plate 1 or as the case may be backwardly and forwardly away from the base plate 1, about this pivot pin 14.

Figure 3:
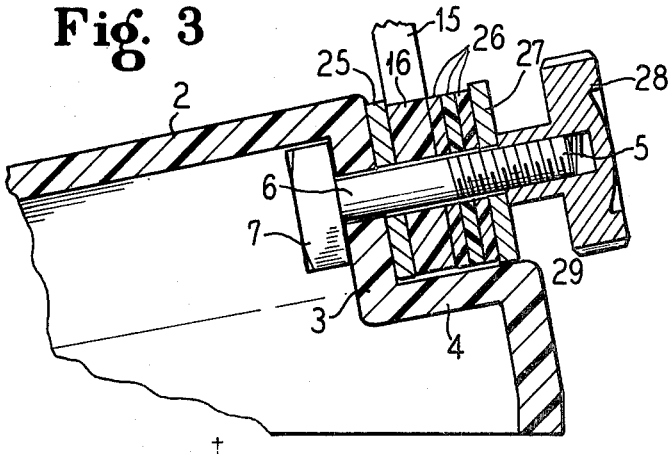
FIG. 3 is a fragmentary longitudinal section taken substantially as indicated by the line III—III of FIG. 2.
Figure 2:
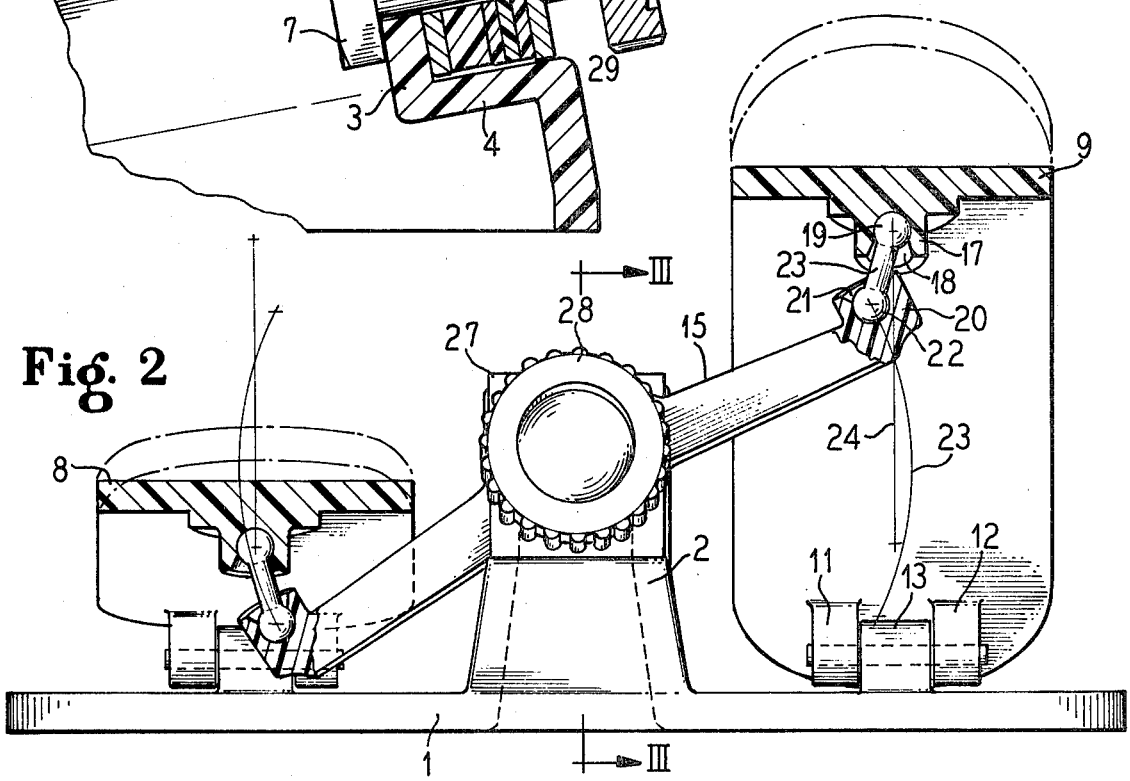
FIG. 2 is a sectional view with parts shown in elevation and parts broken away for clarity taken substantially as indicated by the section line II—II of FIG. 1.

From the showing in FIGS. 1 and 2 of the drawings, it will be noted that while the tread plates 8 and 9 move in opposite directions about the pivot pin 14 the tread plates do not move independently. That is because they are connected by a rocker arm 15 having an enlarged center portion 16 disposed around the aforesaid shaft portion 6 as seen in FIG. 3. This rocker arm 15 may also be molded of a strong plastic such as nylon. Integral with the forward part and depending from the underside thereof of each plate is a cylindrical socket 17 having a tapering entrance 18 for receiving the upper ball 19 of a so-called dog bone universal joint. A similar receiving socket 20 is disposed at each end of the rocker arm 15, this socket being a conical opening 21 and receiving the lower ball 22 carried by the shank 23 connecting both balls together. Since the structure is plastic these balls might be snapped into position, but if that cannot be done the sockets can be split and then put together after the insertion of the dog bone element.

During the downward movement of the plate 9, the lower ball of the joint 22 will follow the arcuate line 23 as seen best in FIG. 2 while the upper ball of the joint will come down along the straight line 24. Of course with plate 8 the lower ball will follow an arcuate line bent in the other direction.

It will be noted that a person can provide more exercise for himself by self resistance to a movement. For example, if a patient wishes to press down foot plate 9, he can apply some resistance with his right foot toward the raising of foot plate 8, and vice versa.

If the patient is not sufficiently strong or able to move one foot and resist the movement with the other foot, means are provided to provide an amount of resistance to movement of the rocker arm 15 that is suitable to that particular patient. These means consist of a washer 25 placed over the bolt shaft 6 in abutment with the wall 3 of the upper extension 2. The enlarged part 16 of the rocker arm 15 is then placed over the bolt axle against the plate 25, a plurality of plastic washers 26 are then put on the shaft and another abutting washer 27 is placed on the shaft. A hand wheel having a knurled or roughened edge to facilitate gripping of the same carries an inward extension internally threaded to fit over the end of the shaft into abutment with the plate 27 and apply frictional resistance to a desired amount by tightening the washers against the bridged portion of the rocker arm. In this way, resistance to the movement of the rocker arm can be made as light as desired or as heavy as desired. Should that patient need repeated usage of the exercise apparatus from day to day, the desired pressure may be marked on the face of the hand wheel 28 and then the pressure can be preset for usage the next time.

From the foregoing it is apparent that the present exercise apparatus is adaptable for use if the patient is bedridden or if he is mobile to a certain extent. For example, if the patient is absolutely lying flat on his back, the apparatus can be propped up against the foot of the bed and the patient can exercise his legs lying flat on his back. Also, if a patient is partly mobile he can exercise his feet or legs on the apparatus while at the same time he is reading, writing or operating a typewriter. That is a definite advantage.

Tests were carried out upon a prototype device substantially like that shown in the drawings. The following table gives an example of these tests and shows pressures which were recorded under conditions of standing, walking, sitting and in the last column, pedaling from a sitting position. All pressures are in mm/Hg.

| | Standing | Walking | Sitting | Pedaling |
|---|---|---|---|---|
| Patient A (Male) | | | | |
| Right Leg | 73 | 7 | 41 | 9 |
| Left Leg | 77 | 0 | 44 | 2 |
| Patient B (Female) | | | | |
| Left Leg | 75 | 17 | 35 | 19 |
| Patient C (Female) | | | | |
| Right Leg | 80 | 25 | 48 | 25 |
| Left Leg | 80 | 40 | 47 | 36 |
| Patient D (Female) | | | | |
| Left Leg | 78 | 30 | 45 | 15 |

From the above table it will be seen from the figures that in all cases substantial reductions in pressure were made using the device over the pressures noted when the patients were simply sitting still. The pressure readings were taken by inserting a catheter into a prominent surface vein on the top of the subject's foot, the catheter was connected to a transducer fitted into a pressure gauge, and the pressure readings were thus intravenous readings. In one case (Patient C) the venous pressure in the left leg was reduced to a value which was actually below that recorded when the patient was walking normally.

I claim:

1. A portable leg exercising apparatus having a base, wherein the improvement comprises left and right foot plates pivoted at the heel ends to said base, a rocker arm pivoted at its center to said base and connected at its opposite ends to said plates whereby said plates pivot in opposite directions but not independently of each other, one of said plates pivoting downwardly while the other plate pivots upwardly, an elevated wall portion on said base, a rocker arm axle extending through said wall portion, a head on said axle abutting one side of the wall, said axle having a threaded end opposite said head, said rocker arm being pivoted on said axle between a pair of washers one of which abuts the other side of said wall, and a hand wheel having an internally threaded portion to engage the threaded end of said axle to selectively compress said rocker arm between said washers and frictionally resist rocking movement of said arm.

2. The apparatus of claim 1, including a plurality of washers compressed by said hand wheel, and a number of said washers being of plastic material, one of which abuts the outer face of said rocker arm.

3. A portable leg exercising apparatus highly desirable for use by bedfast and partially ambulatory patients to maintain proper pressure and flow of blood in the veins, said apparatus including a base, wherein the improvement comprises left and right foot plates pivoted at the heel ends thereof to said base, a rocker arm pivoted at its center to said base and connected at its opposite ends to said foot plates, friction pressure means bearing against the central portion of said rocker arm, and a hand wheel to adjust the amount of frictional resistance to the pivoting of the rocker arm.

4. The apparatus of claim 3, including a fixed axle around which the center of the rocker arm pivots, said hand wheel being threadedly connected to one end of said axle, and said friction pressure means being disposed on said axle behind said hand wheel, whereby the patient has full control of the resistance to pivoting of the rocker arm and a choice of relying only upon the hand wheel adjustment, only on self-resistance, or a combination of both.

5. The apparatus of claim 3, wherein the majority of parts of the apparatus are made of tough light weight plastic and the entire apparatus may be placed in the patient's bed to be used there even if the patient is flat on his back, and if the patient is partially ambulatory he can easily carry the apparatus to where he wants to go.

* * * * *